US005565079A

United States Patent [19]

Griego

[11] Patent Number: 5,565,079

[45] Date of Patent: Oct. 15, 1996

[54] FINE PARTICLE MICROENCAPSULATION AND ELECTROFORMING

[76] Inventor: Thomas P. Griego, 724 Jefferson, Grants, N.M. 87020

[21] Appl. No.: 445,728

[22] Filed: May 22, 1995

Related U.S. Application Data

[63] Continuation-in-part of Ser. No. 295,055, Aug. 26, 1994, Pat. No. 5,487,824.

[51] Int. Cl.[6] ..... C25D 1/00; C25D 7/00

[52] U.S. Cl. ..... 205/67; 205/77; 205/109; 205/122; 205/114; 205/143; 205/144

[58] Field of Search ..... 205/76–77, 109, 205/114, 143–144, 122, 50, 67; 204/212, 269, 279

[56] References Cited

U.S. PATENT DOCUMENTS

| | | | |
|---|---|---|---|
| 2,016,446 | 10/1935 | Merkenschlager | 204/11 |
| 2,085,711 | 6/1937 | Biesmann | 209/179 |
| 3,061,536 | 10/1962 | Gruber | 204/250 |
| 3,359,195 | 12/1967 | Hojyo | 204/212 |
| 3,425,926 | 2/1969 | Hojyo | 204/213 |
| 3,591,466 | 7/1971 | Heiman | 205/114 |
| 3,716,461 | 2/1973 | Ahmad | 205/114 |
| 3,763,001 | 10/1973 | Withers | 205/114 X |
| 3,783,110 | 1/1974 | Ahmad | 205/143 X |
| 4,305,792 | 12/1981 | Kedward et al. | 205/109 |

FOREIGN PATENT DOCUMENTS 612106 4/1935 Germany .

OTHER PUBLICATIONS

Naito, K. et al. *Journal of Applied Electrochemistry* 24 (1994)808–813: "Electrochemical Characteristics of Hydrogen Storage Alloys Modified By Electroless Nickel Coatings".

Naito, K. et al.:*Journal of Applied Electrochemistry* 23 (1993)1051–1055: "Factors Affecting the Characteristics of the Negative Electrodes for Nickel–Hydrogen Batteries".

Ishikawa, H; :*Zeitschrift fur Physikalische Chemie Neue Folge,* Bd. 164, S. 1409–1414(1989): "Microencapsulation and Compaction of Hydrogen Storage Alloy".

Sakai, T. et al.: *Journal of the Less–Common Metals,* 172–174(1991)1194–1204: "Nickel–Metal Hydride Battery Using Micro–Encapsulated Alloys".

Ishikawa, H. et al.: *Journal of the Less–Common Metals,* 107(1985)105–110:"Preparation and Properties of Hydrogen Storage Alloy–Copper Microcapsules".

Isvikawa, H. et al.:*Journal of the Less–Common Metals,* 120(1986)123–133:"Preparation and Properties of Hydrogen Storage Alloys Microencapsulated by Copper".

*Primary Examiner*—Donald R. Valentine
*Attorney, Agent, or Firm*—Jeffrey D. Myers

[57] ABSTRACT

A method and apparatus for microencapsulating or coating powderized material comprising use of a rotary flow-through device to alternately compact and electroplate the powder and reorient it prior to another compaction. The invention is also of a process and apparatus for forming a strip, mesh, or film from powderized material, which is particularly useful for forming misch metal powder composite in nickel mesh for use in metal hydride batteries.

27 Claims, 4 Drawing Sheets

FINE PARTICLE MICROENCAPSULATION AND ELECTROFORMING

CROSS-REFERENCE TO RELATED APPLICATIONS

This application is a continuation-in-part application of U.S. patent application Ser. No. 08/295,055, entitled "Electroplating Apparatus and Electroplating Method of Small Articles", to Griego, filed on Aug. 26, 1994 now U.S. Pat. No. 5,487,824, the teachings of which are incorporated herein by reference.

BACKGROUND OF THE INVENTION

1. Field of the Invention (Technical Field)

The present invention relates to apparatuses and methods for electroplating and electroforming, particularly by centrifugal means and for encapsulation, coating, and electrodeposition of powders, including into bands of mesh or film. The term "electrodeposition" as used throughout the specification and claims means electroplating and/or electroforming.

2. Background Art

The process for microencapsulation of metal hydride electrode powder (and other powders) has previously been limited to chemical copper and electroless nickel deposition. Previous studies of electroplating on fine particles employed equipment capable of handling the light material in an aqueous solution (see FIGS. 1 and 2) but the results were limited because of the difficulty of getting good electrical contact during circulation of the particles, poor cathode efficiency (loss to cathode contact plate and rise in solution ion concentration) and bipolarization, resulting in a costly and unreliable electrolytic process. Likewise, the alternative chemical copper or electroless nickel process was economically infeasible due to the high surface areas of powders.

Referring to FIG. 1 (prior art), a first known particle plating apparatus 11 consists of plating solution 12 surrounding particles 13, anode (Ni or Cu) 14, cathode 15, filter 16, propeller 17, storage tank 18, pump 19, Luggin's capillary 20, and Calomel electrode 21. A second known particle plating apparatus 31, shown in FIG. 2 (prior art), consists of plating bath 32 surrounding particles 33, anode 34, cathode 35, rotary axis 36, carbon brush 37, storage tank 38, pump 39, and tilting angle 40. As noted, these apparatuses are expensive and inefficient.

However, the benefits of microencapsulated metal hydride electrodes, Ishikawa et al, J. Less Common Met. 120:123 (1986), was an important enhancement to the performance and life of metal hydride (MH) batteries, which have twice the energy and life of NiCd cells. This encapsulation had two functions: to encapsulate the Misch metal (Mm) particle to prevent premature decomposition during usage while allowing flow through of gas, and to provide increased conductivity. Sakai et al, J. Less Common Met. 172–174:1194 (1991). This requires that the encapsulations be porous and have a stable interface. The difficulty of developing a cost effective process for making the encapsulation was a limiting factor for commercial applications, as was the need to subsequently compact or cold sinter the loose powder into a self-supporting flexible mesh or plug. The present invention provides such a cost effective process and apparatus for executing the microencapsulation process. The present invention also provides an apparatus and method for centrifugal electroforming of composite powders into mesh and films, which has not heretofore been possible.

SUMMARY OF THE INVENTION (DISCLOSURE OF THE INVENTION)

The present invention is of an improvement to a rotary flow-through electrodeposition apparatus comprising an electrodeposition solution return basin, comprising: a plurality of solution return drains disposable beneath the solution return basin; and a device for switching the solution return basin's position among positions above each of the solution return drains. In the preferred embodiment, the improvement includes a plurality of solution reservoirs, each connected to one or more of the solution return drains. The switching device is preferably rotary and the return drains disposed on an arc traversed by the device.

The present invention is also of an improvement to a rotary flow-through electrodeposition apparatus comprising an anode immersion unit, comprising: a plurality of solution feed nozzles; and an engagement device for switching one of the feed nozzles to provide solution to the anode immersion unit. In the preferred embodiment, the engagement device is rotary.

The invention is additionally of a rotary flow-through electrodeposition apparatus comprising: an anode immersion unit; a plurality of solution feed nozzles; an engagement device for switching one of the feed nozzles to provide solution to the anode immersion unit; a rotary electrolytic cell in which the anode immersion unit is immersed; an electrodeposition solution return basin beneath the rotary electrolytic cell; a plurality of solution return drains disposable beneath the solution return basin; and a device for switching the solution return basin's position among positions above each of the solution return drains. In the preferred embodiment, the engagement device and switching device are rotary (the switching device preferably traversing an arc on which the solution return drains are disposed) and the apparatus includes a plurality of solution reservoirs, each connected to one or more of the solution return drains.

The present invention is further of a method of coating powderized material, comprising: depositing a powderized material having a particle size of from approximately 5 to 500 microns into an electrolytic cell having an annular cathode; circulating an electrodeposition solution into the cell; immersing an anode into the electrodeposition solution; rotating the cell at a speed sufficient to compact the powderized material against the annular cathode; periodically stopping or reversing the rotation of the cell to disperse and reorient the powderized material; and repeating steps d) and e) until the powderized material is electroplated to a predetermined desired condition.

The present is also of a method of forming a strip of powderized material, comprising: depositing a powderized material having a particle size of from approximately 5 to 500 microns into an electrolytic cell; circulating an electrodeposition solution into the cell; rotating the cell at a speed sufficient to compact the powderized material against a solid against a periphery of the cell; immersing an anode into the electrodeposition solution; and electrodepositing until the powdered material bonds or electroforms together. In the preferred embodiment, electrodepositing comprises electrodepositing until the powdered material bonds or electroforms together in a strip (preferably an approximately uniform mesh or film). For a mesh, a filler material (such as fibers, granules, beads, particles, composites, or wires) can be deposited and then eliminated after electrodeposition to increase porosity of the mesh. Amperage density may also be adjusted to alter porosity of the mesh. The solution and anode may be changed to form a multi-layered composition. To decrease porosity of a film, additional powderized material may be introduced following the electrodepositing step and electrodeposition resumed. Preferably, the cell is rotated at a speed sufficient to compact the powderized material against an annular cathode or a conductive form against a periphery of the cell.

The present invention is also of a coated powderized material manufactured by the steps of: depositing a powderized material having a particle size of from approximately 5 to 500 microns into an electrolytic cell having an annular cathode; circulating an electrodeposition solution into the cell; immersing an anode into the electrodeposition solution; rotating the cell at a speed sufficient to compact the powderized material; periodically stopping or reversing the rotation of the cell to disperse and reorient the powderized material; and repeating steps d) and e) until the powderized material is electrodeposited to a predetermined desired condition.

The present invention is further of a structure comprising powderized material manufactured according to the steps of: depositing a powderized material having a particle size of from approximately 5 to 500 microns into an electrolytic cell; circulating an electrodeposition solution into the cell; rotating the cell at a speed sufficient to compact the powderized material; immersing an anode into the electrodeposition solution; and electrodepositing until the powdered material bonds or electroforms together in a structure. In the preferred embodiment, electrodepositing occurs until the powdered material bonds or electroforms together in a strip, mesh, or film. Filler material (such as fibers, granules, beads, particles, composites, and/or wires) may be deposited and later eliminated to increase porosity of the structure. Amperage density may be adjusted to alter porosity, as well. The solution and anode may be changed during the process to form a multi-layered composition structure, and additional powderized material may be added following electrodeposition and electrodeposition then continued to decrease porosity of the structure. Preferably, the cell is rotated at a speed sufficient to compact the powderized material against an annular cathode or conductive form against a periphery of the cell. The structure formed by the process may be misch metal powder composite in nickel mesh, platinum plated powder mesh, bonded diamond or other abrasive, engineered composite film for wear surface guides or bearings, dielectric films, non-leachable and chemically inert film composite of radioactive isotope particles, composite films for sensor devices or fuses, electroformed sintered type membranes, composite strips bearing blended microencapsulated reactive materials with critical stoichiometry for detonation devices, composite alloy films with post thermoformable engineering polymer resins, or high conductive heating elements.

A primary object of the apparatus of the present invention is to permit a multi-step electroplating process without physical transfer of the plating fixture or cumbersome manual exchange of solutions.

A primary object of the processes of the invention is to provide for effective microencapsulation of powdered materials, formation of mesh of such materials, and electroforming of such materials.

A primary advantage of the apparatus of the present invention is that micron-sized particles can be microencapsulated.

Another advantage of the apparatus of the present invention is that materials can be plated many times faster than with existing technology.

An additional advantage of the apparatus of the present invention is that only the inside of the cell is wetted by chemistry and all solutions are exchanged using high speed rotation for removal.

Another advantage of the apparatus of the invention is that it can be used in both anodic and cathodic modes: anodic for electrocleaning, electropolishing, anodizing powder materials, and electrodialysis; cathodic for electrodeposition.

A primary advantage of the processes of the invention is that a wide-range of useful articles may be made thereby, including but not limited to misch metal powder composite in nickel mesh, platinum plated powder mesh, bonded diamond or other abrasive, engineered composite film for wear surface guides or bearings, dielectric films, non-leachable and chemically inert film composite of radioactive isotope particles, composite films for sensor devices or fuses, electroformed sintered type membranes, composite strips bearing blended microencapsulated reactive materials with critical stoichiometry for weapons detonation devices, composite alloy films with post thermo-formable engineering polymer resins, and high conductive heating elements.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

(BEST MODES FOR CARRYING OUT THE INVENTION)

The present invention relates to an automated centrifugal apparatus and method for electrolytically encapsulating loose conductive powderized materials with nickel or other electroplated metal and then unitizes the loose powders into a flexible wide strip self-supporting mesh or film by electroforming under centrifugal force. The rotary flow-through plating cell of the invention provides for microencapsulation of particles in the size range of 5–500 microns and, for example, a plating thickness of 1 micron of nickel. Metal hydride battery applications require the deposit to have a porous surface to allow the hydration and dehydration process that occurs during the charge/discharge cycles.

The present invention employs a high efficiency electrolytic process and observes kinetic patterns to control the porosity and coverage of microencapsulation.

The present invention employs centrifugal force to separate and compact the loose fine particle materials in a solution against an electrolytic cathode contact. The powderized material is loaded through a top opening and the plating cell is rotated at sufficient high rpm to centrifugally cast the powder against the cathode contact. Electrodeposition solution is then introduced at the top opening of the rotating cell and flows through the cell exiting through a porous ring (e.g., a sintered plastic ring) layered between the domed top, cathode contact ring, and base plate. Electroplating is carried out with a cycle of periodic stopping and/or counter rotation and sequential switching of the DC power supply to the cell to circulate the particle position for even coverage and prevention of agglomeration (bridging).

An advantage of the present invention is that micron fine, light weight, powderized materials with low conductivity (or high resistivity) can be efficiently electroplated under centrifugal force. Another advantage is that the process solutions are freely circulated throughout the cell to provide optimum conditions of electrolyte, ion concentration, pH, temperature, and solution purity. A further advantage is the ability to molecularly bond the powders together in a conductive electrodeposited network that has superior conductivity and mechanical stability than cold sintered formations.

Figure 1:
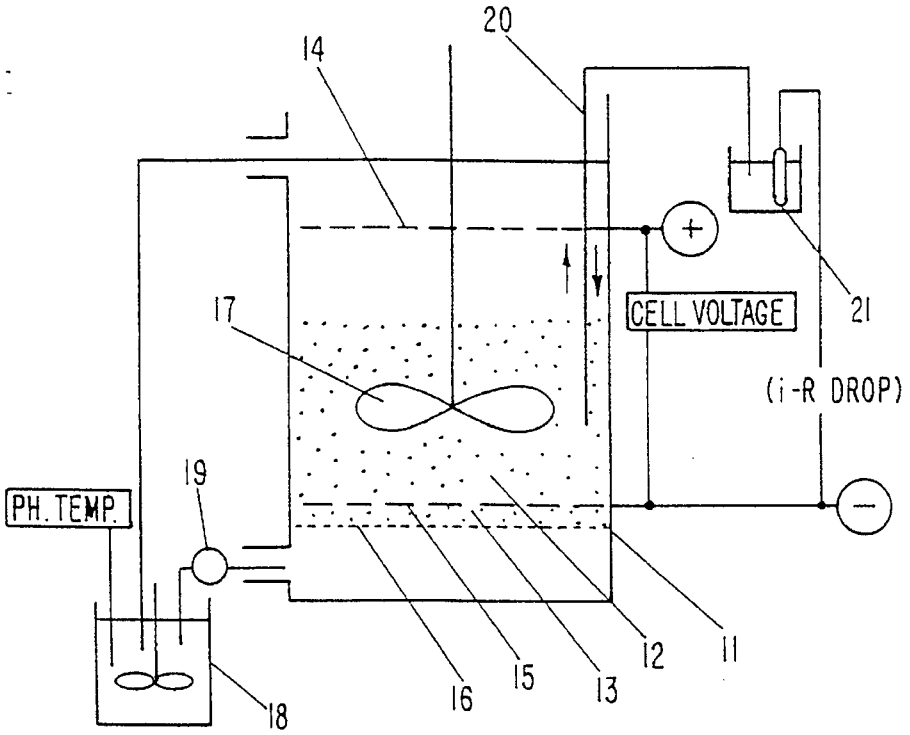
FIG – 1 (PRIOR ART)
FIG. 1 illustrates a first prior art apparatus for microencapsulation of powders.
Figure 2:
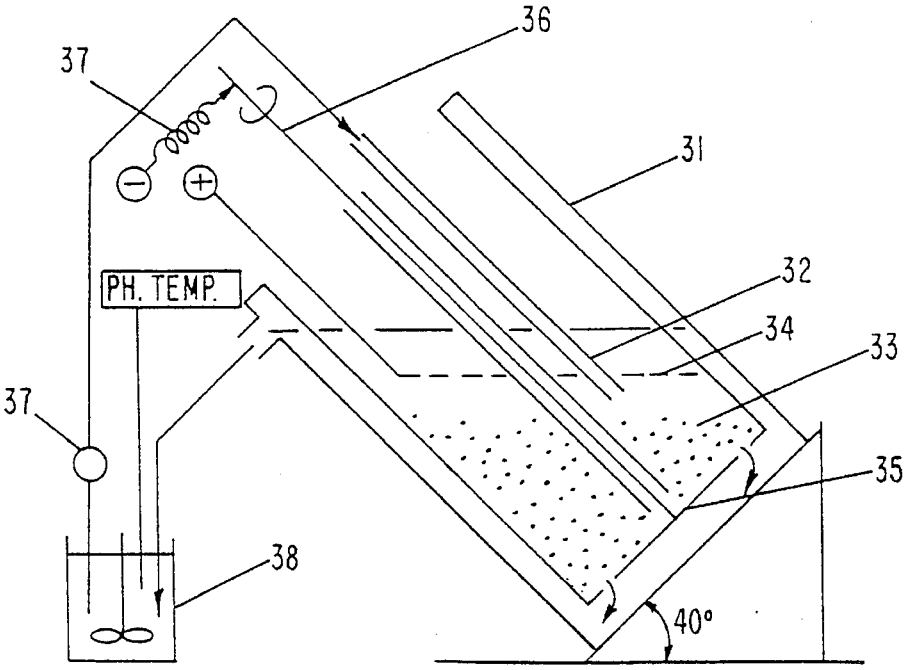
FIG – 2 (PRIOR ART)
FIG. 2 illustrates a second prior art apparatus for microencapsulation of powders.
Figure 3:
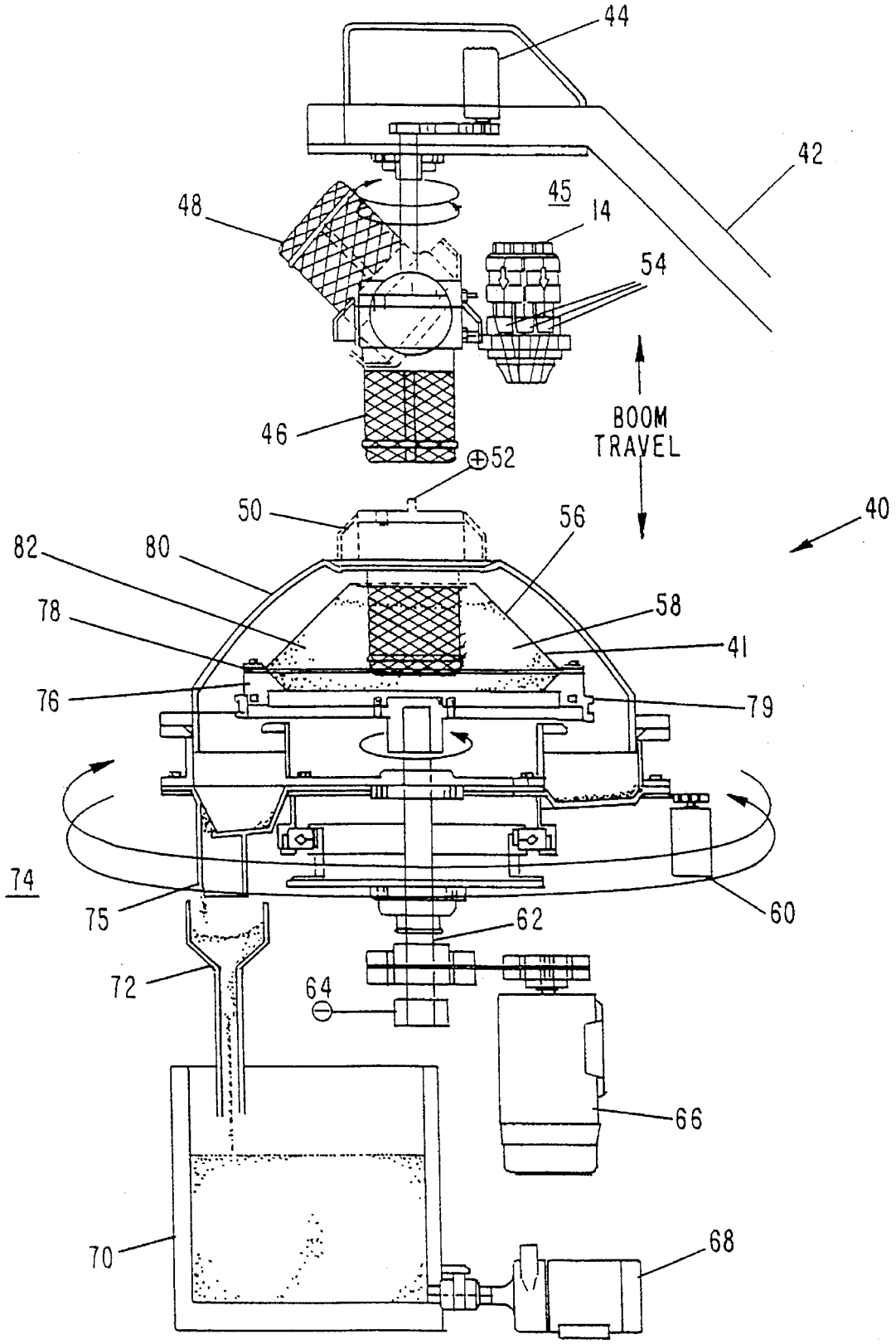
FIG. 3 is a cutaway view of the preferred apparatus of the invention.
Figure 4:
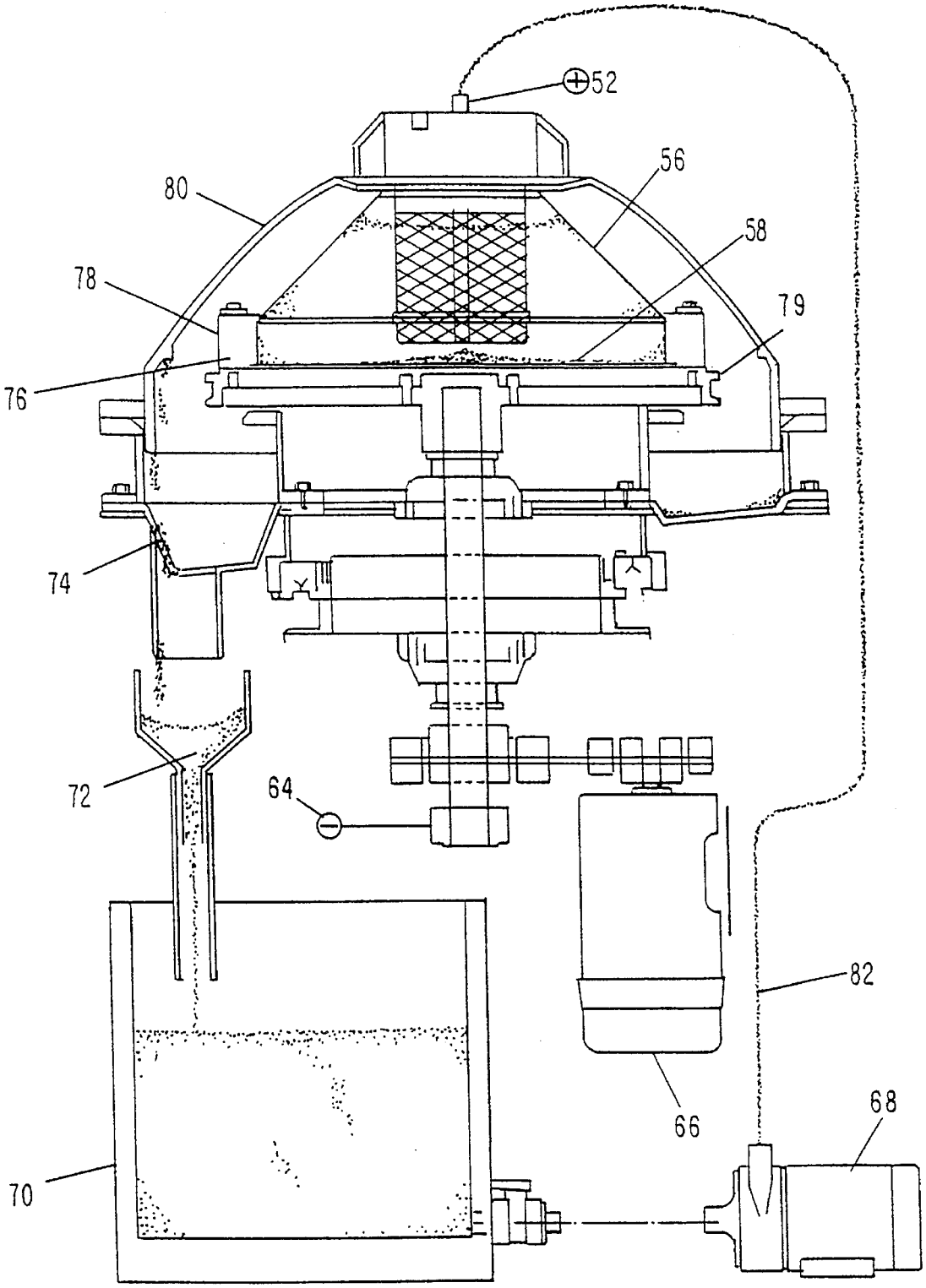
FIG. 4 is a cutaway view of the preferred apparatus of the invention (absent boom and feed nozzles) prior to rotation.
Figure 5:
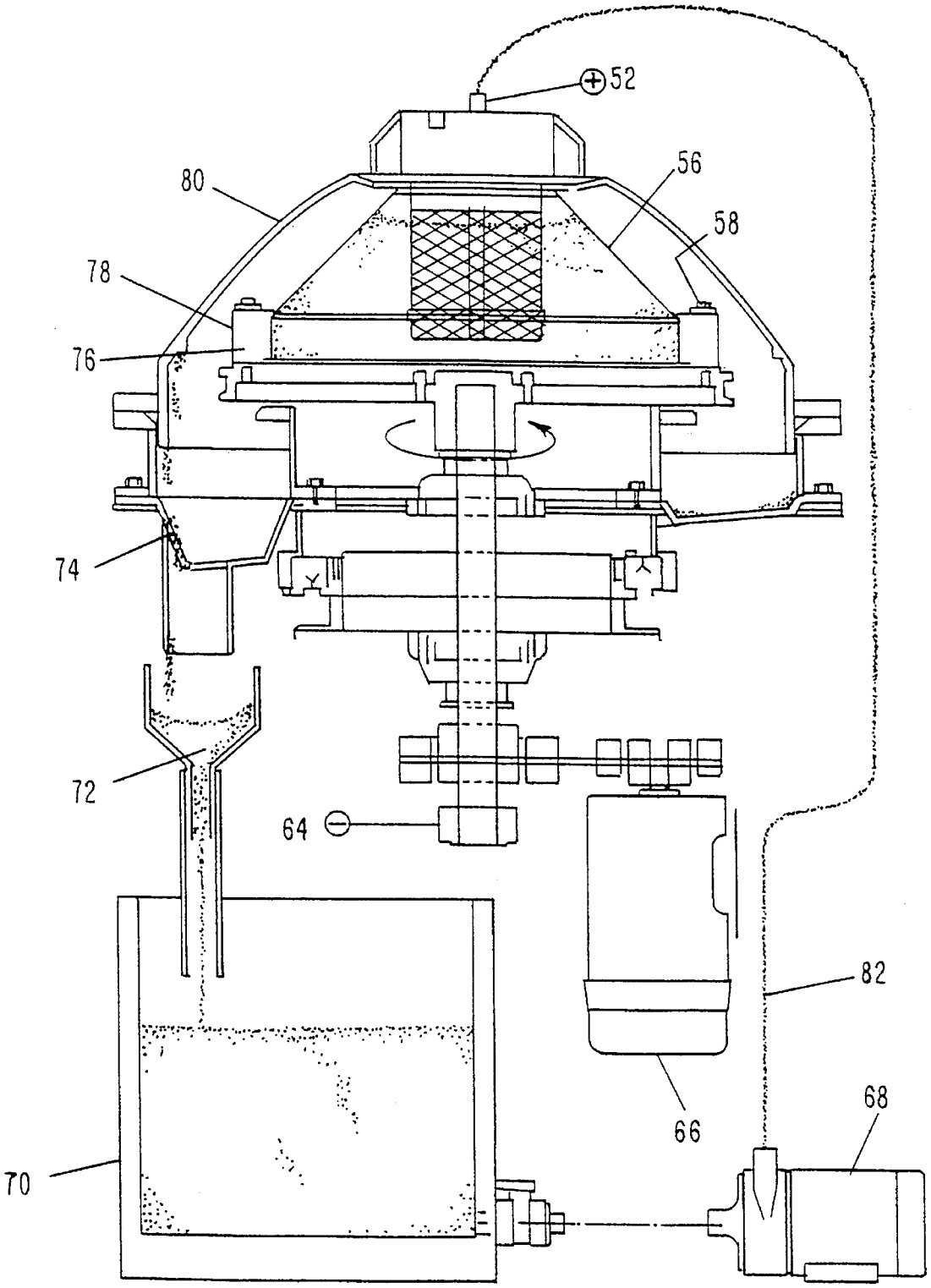
FIG. 5 is a cutaway view of the preferred apparatus of the invention (absent boom and feed nozzles) during rotation.

Turning to FIGS. 3–5, the preferred rotary flow-through plating apparatus (cell) of the present invention 40 comprises a truncated conical drum 41, vertically mounted on a rotating shaft 62 capable of high rotation speed driven by drive motor 66. The cell is operated within a concentric rotating basin 74 that can align a drain port 75 via drive motor 60 over multiple return drains 72 distributed at the radius of the cell which return electrodeposition solution 82 to one of multiple solution reservoirs 70. The electrodeposition solution 82 is then recirculated to the cell by circulation pump 68 and recirculation line 82 (preferably plastic tubing). The drum 41 comprises an open ended dome 56, a cathode contact annular ring 76 (preferably titanium), a porous annular ring 78 (preferably sintered plastic), and a circular base plate 79. The cell also preferably includes a rotating accessory head 45 with multiple feed nozzles 54 providing solution to anode 46 (in position for immersion) and 48 (swung up for clearance) to allow sequential chemical process steps to be carried out in the same cell without elaborate non-automated by-pass switching of materials and equipment in mid-process. Rotating accessory head 45 is moved up and down from boom 42 by drive motor 44. When lowered into operating position 50, the anode acts as positive terminal 52 for the electrolytic process performed in the cell together with negative terminal 64. Canopy 80 provides protection to the ambient environment from process-related fumes, and contains process solutions during operations. Optionally, anode and cathode can be switched to operate the apparatus in anodic rather than cathodic mode.

FIG. 4 illustrates material to be plated 58 prior to rotation distributed over circular base plate 79. FIG. 5 shows material 58 during rotation compacted against cathode contact ring 76.

The sequential positioning of the nozzles, anodes (the anode can be easily removed and switched to provide for deposition of different metals), and drain port provides a method to expose the materials being plated to a multiple step chemical process without intermixing the chemistry. Furthermore, the continuous immersion of the plated work prevents oxidation that normally occurs on the substrate when transferred from tank to tank in the conventional barrel plating process. The continuous immersion is preferably achieved by performing all steps of the process in the same cell. The chemical solutions are sequentially returned via the porous ring to the appropriate return drain for a discrete circulation of each chemical solution. Then by introducing the rinse water during high speed rotation the chemical solutions are exchanged with minimal dilution due to the differing specific weights. Subsequent steps are then carried out in the same manner until the plating film is deposited.

Figure 6:
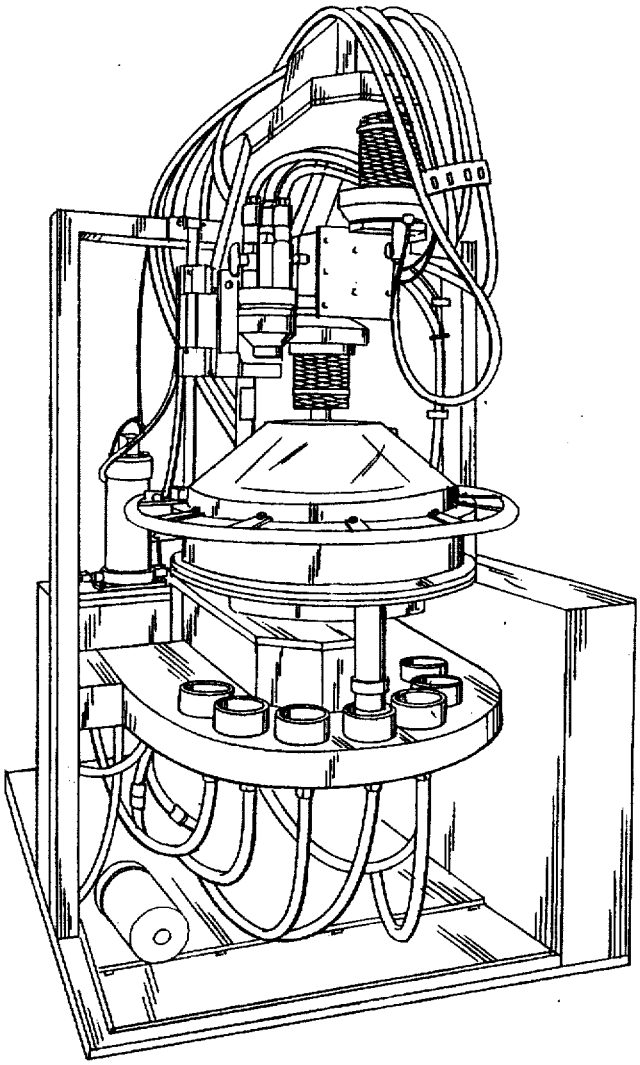
FIG. 6 is a perspective view of the preferred apparatus of the invention.

The preferred cell shown in perspective view in FIG. 6 has significant advantages over preexisting apparatuses for electroplating. The cell preferably has a stainless steel frame, a seamless thermoformed cell and canopy, user programmable logic control with touch screen interface (not shown), AC inverter control drive and pumps, precision linear guides, robotic actuators, redundant safety interlocks, full shielding for safety, full automation or manual control, and a break-away control panel (not shown) for multiple unit modular configuration. Utilizing two anodes (soluble or insoluble for dual metal depositions), four chemistry reservoir tanks, seven solution return drains, and three feed nozzles (although effectively any number of these components is possible), the cell provides for up to 16 sequential process steps. The process is enclosed for effective fume control, has high volume solution flow through for high speed plating, and has a large cathode contact area. A cell having a 42"×78" footprint has the capacity to process approximately 1 liter of material having particle sizes from 5 microns to 5 mm with 100% cathode efficiency, provides plating speeds approximately five times faster than horizontal barrel apparatuses due to the high current settings permitted by the hydrodynamics of the cell and the rotating cathode, and can use as little as 250 ml of rinsing solution per rinse cycle.

The preferred cell process flow for electrolytic encapsulation of discrete particles with nickel plate (as an example) is as follows:

Load conductive powder;

Rinse;

Hot soak;

Nickel plate with start/stop cycle;

Rinse;

Hot rinse; and

Vacuum dry.

The apparatus of the invention may also be used to produce a porous mesh or solid film using conductive and non-conductive powderized materials carried out in a high speed rotating plating cell (centrifuge). A composite of powder or granular material is measured and placed into the rotating cell. An electrodeposition solution is then circulated through the cell and under centrifugal force the loose powder material forms a compacted bed covering the inner surface of the annular cathode contact ring. A soluble anode is then placed inside the cell and under continuous rotation, electrodeposition is carried out until the composite powdered material is bonded or electroformed together in a uniform band. Particles bridge together or agglomerate under controlled process with predictable results. The resulting strip can then be further processed by burning off filler material such as carbon fiber or plastic granules to increase the porosity of the mesh. Using the same process, non-porous composite films can be electroformed with stratified layer formations of various composition by introducing additional powdered materials of various specific weight or by layering a subsequent bed of powder over an electroformed composition and then continued electrodeposition.

The cross-section profile and thickness of the resulting mesh is determined by the amount of loose powder loaded, the size and density of the particles and the makeup of the blended composition. The shape, width, and surface finish of the inside diameter surface of the cathode contact ring will determine the profile and width of the outer surface of the electroformed mesh or film. A layered composition of various conductive and non-conductive particles is possible by electrodeposition over subsequent bed layers of material. The porosity of a metal mesh is determined by the amperage density used during electrodeposition and by the selection and proportion of a burnable fiber or particle material. The primary benefit of this electroforming method is that various components both conductive and non-conductive can be blended and then bonded into a composite mesh or film that is enhanced by the collective properties of the composition in a robust, flexible or rigid support that can be incorporated into many applications.

The preferred process flow for centrifugally electroforming a wide band composite mesh or film is as follows:

Load composite powders, particles, or fibers (conductive or non-conductive);

Rinse;

Hot soak;

Plate with continuous rotation;

Rinse;

Alternate cold and hot rinse;

Peel off mesh or film from cathode surface; and

Burn off fibers for mesh, or other final operation.

INDUSTRIAL APPLICABILITY

The present invention is particularly useful in the following applications:

Misch metal powder composite in nickel mesh for use in metal hydride batteries as a negative electrode;

Platinum plated powder mesh for use in fuel cells;

Diamond or abrasive bonding for grinding and cutting tools;

Engineered composite film for wear surface guides and bearings;

Dielectric films for electronic and industrial power capacitance or resistance components;

Non-leachable, chemically inert film composite of radioactive isotope particles for medical and industrial processes;

Composite films for sensor devices and fuses;

Electroformed sintered type membranes and three dimensional articles;

Composite films and mesh bearing blended microencapsulated reactive materials with critical stoichiometry for detonation devices;

Composite alloy films with post thermo-formable engineering polymer resins that can be used in insert injection molding for enhancing certain contact or wear surfaces of molded parts; and High conductive film or mesh heating elements.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of coating powderized material, the method comprising the steps of:

a) depositing a powderized material having a particle size of from approximately 5 to 500 microns into an electrolytic cell having an annular cathode;

b) circulating an electrodeposition solution into the cell;

c) immersing an anode into the electrodeposition solution;

d) rotating the cell at a speed sufficient to compact the powderized material against the annular cathode;

e) periodically stopping or reversing the rotation of the cell to disperse and reorient the powderized material; and f) repeating steps d) and e) until the powderized material is electroplated to a desired condition.

2. The method of claim 1 wherein the depositing step comprises depositing a powderized material into an electrolytic cell having a titanium annular cathode.

3. A method of forming a strip of powderized material, the method comprising the steps of:

a) depositing a powderized material having a particle size of from approximately 5 to 500 microns into an electrolytic cell,;

b) circulating an electrodeposition solution into the cell;

c) rotating the cell at a speed sufficient to compact the powderized material against a solid against a periphery of the cell;

d) immersing an anode into the electrodeposition solution; and e) electrodepositing until the powdered material bonds or electroforms together.

4. The method of claim 3 wherein the electrodepositing step comprises electrodepositing until the powdered material bonds or electroforms together in a strip.

5. The method of claim 4 wherein the electrodepositing step comprises electrodepositing until the powdered material bonds or electroforms together in an approximately uniform mesh.

6. The method of claim 5 additionally comprising the steps of depositing a filler material into the cell and eliminating the filler material after electrodeposition to increase porosity of the mesh.

7. The method of claim 6 wherein the step of depositing a filler material comprises depositing a filler material selected from the group consisting of fibers, granules, beads, particles, composites, and wires.

8. The method of claim 5 additionally comprising the step of adjusting an amperage density to alter porosity of the mesh.

9. The method of claim 3 additionally comprising the step of changing solution and anode to form a multi-layered composition.

10. The method of claim 3 wherein the electrodepositing step comprises electrodepositing until the powdered material bonds or electroforms together in an approximately uniform film.

11. The method of claim 10 additionally comprising the step of introducing additional powderized material following the electrodepositing step and repeating steps c) to e) to decrease porosity of the film.

12. The method of claim 3 wherein the rotating step comprises rotating the cell at a speed sufficient to compact the powderized material against an annular cathode against a periphery of the cell.

13. The method of claim 12 wherein the rotating step comprises rotating the cell at a speed sufficient to compact the powderized material against a conductive form against a periphery of the cell.

14. The method of claim 12 wherein the rotating step comprises rotating the cell at a speed sufficient to compact the powderized material against a titanium annular cathode against a periphery of the cell.

15. A coated powderized material manufactured by the steps of:

a) depositing a powderized material having a particle size of from approximately 5 to 500 microns into an electrolytic cell having an annular cathode;

b) circulating an electrodeposition solution into the cell;

c) immersing an anode into the electrodeposition solution;

d) rotating the cell at a speed sufficient to compact the powderized material;

e) periodically stopping or reversing the rotation of the cell to disperse and reorient the powderized material; and f) repeating steps d) and e) until the powderized material is electrodeposited to a desired condition.

16. The material of claim 15 wherein the depositing step comprises depositing a powderized material into an electrolytic cell having a titanium annular cathode.

17. A structure comprising powderized material manufactured according to the steps of:

a) depositing a powderized material having a particle size of from approximately 5 to 500 microns into an electrolytic cell;

b) circulating an electrodeposition solution into the cell;

c) rotating the cell at a speed sufficient to compact the powderized material;

d) immersing an anode into the electrodeposition solution; and e) electrodepositing until the powdered material bonds or electroforms together in a structure.

18. The structure of claim 17 wherein the electrodepositing step comprises electrodepositing until the powdered material bonds or electroforms together in a structure selected from the group consisting of a strip, a mesh, and a film.

19. The structure of claim 17 additionally comprising the steps of depositing a filler material into the cell and eliminating the filler material to increase porosity of the structure.

20. The structure of claim 19 wherein the step of depositing a filler material comprises depositing a filler material selected from the group consisting of fibers, granules, beads, particles, composites, and wires.

21. The structure of claim 17 additionally comprising the step of adjusting an amperage density to alter porosity of the structure.

22. The structure of claim 17 additionally comprising the step of changing solution and anode to form a multi-layered composition structure.

23. The structure of claim 17 additionally comprising the step of introducing additional powderized material following the electrodepositing step and repeating steps c) to e) to decrease porosity of the structure.

24. The structure of claim 17 wherein the rotating step comprises rotating the cell at a speed sufficient to compact the powderized material against an annular cathode against a periphery of the cell.

25. The structure of claim 24 wherein the rotating step comprises rotating the cell at a speed sufficient to compact the powderized material against a conductive form against a periphery of the cell.

26. The structure of claim 24 wherein the rotating step comprises rotating the cell at a speed sufficient to compact the powderized material against a titanium annular cathode against a periphery of the cell.

27. The structure of claim 17 wherein said structure comprises a member selected from the group consisting of misch metal powder composite in nickel mesh, platinum plated powder mesh, bonded diamond or other abrasive, engineered composite film for wear surface guides or bearings, dielectric films, non-leachable and chemically inert film composite of radioactive isotope particles, composite films for sensor devices or fuses, electroformed sintered type membranes, composite strips bearing blended microencapsulated reactive materials with critical stoichiometry for detonation devices, composite alloy films with post thermoformable engineering polymer resins, and high conductive heating elements.

* * * * *

UNITED STATES PATENT AND TRADEMARK OFFICE

CERTIFICATE OF CORRECTION

PATENT NO. : 5,565,079

DATED : October 15, 1996

INVENTOR(S) : Thomas P. Griego

It is certified that error appears in the above-identified patent and that said Letters Patent is hereby corrected as shown below: in the Drawings:

"Add Drawing Sheet 5 as Figure 6 attached hereto" which is incorporated into and forms a part of the specification, illustrating a view of the preferred apparatus of the invention.

On the title page following the ABSTRACT paragraph, indicate: "27 Claims, 5 Drawing Sheets"

In the Drawings, add the drawing Sheet 5 consisting of Fig. 6, as shown on the attached page.

Signed and Sealed this

Twenty-ninth Day of April, 1997

Bruce Lehman

*Attest:*

BRUCE LEHMAN

*Attesting Officer*

*Commissioner of Patents and Trademarks*